US006910245B2

(12) United States Patent
Hawkins et al.

(10) Patent No.: US 6,910,245 B2
(45) Date of Patent: Jun. 28, 2005

(54) UPRIGHT VACUUM CLEANER WITH CYCLONIC AIR PATH

(75) Inventors: Thomas Hawkins, Normal, IL (US); Rich Eisenmenger, Champaign, IL (US); Len Hampton, Normal, IL (US); Christer Kontio, Bloomington, IL (US)

(73) Assignee: White Consolidated Industries, Inc., Cleveland, OH (US)

( * ) Notice: Subject to any disclaimer, the term of this patent is extended or adjusted under 35 U.S.C. 154(b) by 69 days.

(21) Appl. No.: 09/759,391

(22) Filed: Jan. 12, 2001

(65) Prior Publication Data

US 2002/0029436 A1 Mar. 14, 2002

Related U.S. Application Data

(60) Provisional application No. 60/176,374, filed on Jan. 14, 2000.

(51) Int. Cl.[7] ..... A47L 9/12; A47L 9/16

(52) U.S. Cl. ..... 15/339; 15/347; 15/353; 55/321; 55/327; 55/DIG. 3

(58) Field of Search ..... 15/347, 350, 351, 15/352, 353, 339; 55/321, 337, DIG. 3

(56) References Cited

U.S. PATENT DOCUMENTS

| | | | |
|---|---|---|---|
| 1,003,844 | A | 9/1911 | Winans |
| 1,029,562 | A | 6/1912 | Prentiss |
| 1,127,896 | A | 2/1915 | Keller |

(Continued)

FOREIGN PATENT DOCUMENTS

| | | |
|---|---|---|
| DE | 398849 | 7/1924 |
| DE | 570610 | 2/1933 |
| EP | 0 966 912 A1 | 12/1999 |

(Continued)

OTHER PUBLICATIONS

"Chapter 6: Centrifugal Separations" Industrial Gas Cleaning Second Edition, by W. Strauss, Pergamon Press, 1975, pp. 216–276.

IonaCare Fantom™ Model F–9000 Owner's Manual (© 1991).

Fantom™ Vacuum Cleaner Service Manual for Iona® Model Series F–9000.

(Continued)

*Primary Examiner*—Terrence R. Till
(74) *Attorney, Agent, or Firm*—Pearne & Gordon LLP

(57) ABSTRACT

An upright vacuum cleaner with a cyclonic airflow path includes a floor-engaging base unit, a body unit pivotally mounted to the base unit and a motor/fan assembly mounted on one of the base unit or body units. A dirt collecting enclosure is also mounted on the body unit and includes a first large chamber and a second smaller chamber. A filter unit is disposed in the first large chamber. Dirt laden air is introduced into the first large chamber in a tangential manner so as to impart a cyclonic action to the airflow. The filter in the first large chamber is effective for removing larger particles of debris from the airflow. The remaining airflow is communicated to the second chamber where smaller particles of debris are removed. Airflow from the second smaller chamber is then communicated through a cyclonic chamber disposed above and transverse to the dirt collecting enclosure, to a third chamber where a second filter is disposed. The smallest particles of debris are removed from the airflow by the second filter disposed in this third chamber. The upright vacuum cleaner can include an arrangement for sensing pressure differences across one or more of the filters thereby providing an indication that the filter is dirty or clogged. The upright vacuum cleaner can also include an elevator mechanism for raising and lowering the dirt collecting enclosure thereby facilitating the task of emptying and then reinstalling the dirt collecting enclosure.

44 Claims, 8 Drawing Sheets

U.S. PATENT DOCUMENTS

| | | | |
|---|---|---|---|
| 1,133,543 | A | 3/1915 | Duffie |
| 1,230,827 | A | 6/1917 | Duffie |
| 1,234,095 | A | 7/1917 | Duffie |
| 1,507,271 | A | 9/1924 | Bennett |
| 1,508,315 | A | 9/1924 | Brockway |
| 1,768,617 | A | 7/1930 | Lee |
| 1,887,600 | A | 11/1932 | Replogle |
| 2,193,479 | A | 3/1940 | Donaldson |
| 2,252,581 | A | 8/1941 | Saint-Jacques |
| 2,375,608 | A | 5/1945 | Young |
| 2,402,845 | A | 6/1946 | Rodman |
| 2,475,808 | A | 7/1949 | Storm |
| 2,516,707 | A | 7/1950 | Lewyt |
| 2,523,614 | A | 9/1950 | Elverum |
| 2,524,117 | A | 10/1950 | Storm |
| 2,604,956 | A | 7/1952 | Israel |
| 2,824,335 | A | 2/1958 | Moffat |
| 2,863,525 | A | 12/1958 | Lucian |
| 2,921,646 | A | 1/1960 | Poole |
| 3,052,361 | A | 9/1962 | Whatley |
| 3,210,061 | A | 10/1965 | Nogiwa |
| 3,234,713 | A | 2/1966 | Harper |
| 3,320,727 | A | 5/1967 | Farley |
| 3,343,344 | A | 9/1967 | Fairaizl |
| 3,423,909 | A | 1/1969 | Bennett |
| 3,425,192 | A | 2/1969 | Davis |
| 3,543,325 | A | 12/1970 | Hamrick |
| 3,626,545 | A | 12/1971 | Sparrow |
| 3,672,130 | A | 6/1972 | Sullivan |
| 3,820,310 | A | 6/1974 | Fromknecht |
| 3,853,518 | A | 12/1974 | Tu |
| 3,870,486 | A | 3/1975 | Eriksson et al. |
| 3,877,902 | A | 4/1975 | Eriksson et al. |
| 4,108,778 | A | 8/1978 | Lambert |
| 4,237,006 | A | 12/1980 | Colman |
| 4,251,368 | A | 2/1981 | Colman |
| 4,268,288 | A | 5/1981 | Coombs |
| 4,373,228 | A | 2/1983 | Dyson |
| 4,443,235 | A | 4/1984 | Brenholt |
| 4,490,162 | A | 12/1984 | Davis |
| 4,571,772 | A | 2/1986 | Dyson |
| 4,593,429 | A | 6/1986 | Dyson |
| 4,678,588 | A | 7/1987 | Shortt |
| 4,718,924 | A | 1/1988 | DeMarco |
| 4,853,008 | A | 8/1989 | Dyson |
| 4,944,780 | A | 7/1990 | Usmani |
| 5,020,186 | A | 6/1991 | Lessig, III |
| 5,078,761 | A | 1/1992 | Dyson |
| 5,080,697 | A | 1/1992 | Finke |
| 5,101,532 | A | 4/1992 | Dyson et al. |
| 5,106,488 | A | 4/1992 | Jonasson |
| 5,135,552 | A | 8/1992 | Weistra |
| 5,141,528 | A | 8/1992 | Boczkiewicz et al. |
| 5,160,356 | A | 11/1992 | Dyson |
| 5,230,722 | A | 7/1993 | Yonkers |
| 5,248,323 | A | 9/1993 | Stevenson |
| 5,255,411 | A | 10/1993 | Da Costa |
| 5,267,371 | A | 12/1993 | Soler et al. |
| 5,307,538 | A | 5/1994 | Rench et al. |
| 5,350,432 | A | 9/1994 | Lee |
| 5,558,697 | A | 9/1996 | Dyson et al. |
| 5,603,740 | A | 2/1997 | Roy |
| 5,659,922 | A | 8/1997 | Louis |
| 5,725,623 | A | 3/1998 | Bowerman et al. |
| 5,779,745 | A | 7/1998 | Kilström |
| 5,795,358 | A | 8/1998 | Scanlon et al. |
| D398,097 | S | 9/1998 | Murphy et al. |
| 5,840,103 | A | 11/1998 | Dyson |
| 5,853,440 | A | 12/1998 | Dyson |
| 5,858,038 | A | 1/1999 | Dyson et al. |
| 5,893,936 | A | 4/1999 | Dyson |
| 5,935,279 | A | 8/1999 | Kilström |
| 5,950,274 | A | 9/1999 | Kilström |
| 6,003,196 | A | 12/1999 | Wright et al. |
| 6,012,200 | A | 1/2000 | Murphy et al. |
| 6,026,540 | A | 2/2000 | Wright et al. |
| 6,070,291 | A | 6/2000 | Bair et al. |
| 6,085,382 | A | 7/2000 | Bobrosky et al. |
| D433,201 | S | 10/2000 | Wright et al. |
| 6,141,826 | A * | 11/2000 | Conrad et al. |
| 6,146,434 | A | 11/2000 | Scalfani et al. |
| 6,192,550 | B1 | 2/2001 | Hamada et al. |
| 6,238,451 | B1 | 5/2001 | Conrad et al. |
| 6,260,234 | B1 | 7/2001 | Wright |
| 6,332,239 | B1 | 12/2001 | Dubos et al. |
| 6,334,234 | B1 * | 1/2002 | Conrad et al. |
| 6,350,292 | B1 | 2/2002 | Lee et al. |

FOREIGN PATENT DOCUMENTS

| | | |
|---|---|---|
| EP | 1 042 980 B1 | 10/2000 |
| EP | 0 918 481 B1 | 11/2001 |
| EP | 1 157 650 A2 | 11/2001 |
| EP | 1 157 651 A2 | 11/2001 |
| EP | 1 157 650 A3 | 12/2001 |
| EP | 1 157 651 A3 | 12/2001 |
| FR | 891643 | 12/1943 |
| FR | 1468142 | 2/1966 |
| GB | 479455 | 2/1938 |
| GB | 1111074 | 4/1968 |
| GB | 2246717 | 2/1992 |
| GB | 2298598 | 9/1996 |
| JP | 54-121568 | 9/1979 |
| JP | 8-322769 | 12/1996 |
| SE | 119307 | 7/1947 |
| WO | WO 84/02282 | 6/1984 |
| WO | WO 99/22873 | 5/1999 |
| WO | WO 99/22874 | 5/1999 |
| WO | WO 99/30605 | 6/1999 |
| WO | WO 99/59458 | 11/1999 |
| WO | WO 00/21428 | 4/2000 |
| WO | WO 00/36962 | 6/2000 |
| WO | WO 00/49932 | 8/2000 |

OTHER PUBLICATIONS

Fantom® Owner's Manual (© 1993).
Fantom® Fury™ Vacuum Owner's Manual (© 1995).
Fantom® Thunder™ Vacuum Owner's Manual (© 1997).
Dyson DC03 Operating Manual (© 1997).

* cited by examiner 10
40
42
44
46
50
52
100
52a
54
102
29
62
36
32
34
60
30
74
76
70
72
28
22
14
20
84
86
80a
80
82

UPRIGHT VACUUM CLEANER WITH CYCLONIC AIR PATH

This application claims the benefit of U.S. Provisional Application Ser. No. 60/176,374 filed Jan. 14, 2000, the entire contents of which are incorporated herein by reference in their entirety.

FIELD OF THE INVENTION

This invention relates to an improved upright vacuum cleaner having a cyclonic air path. More particularly, this invention relates to such a vacuum cleaner as provides the operator with improved performance features such as a visual indication of the condition of a removable filter to allow for more timely cleaning of such filter, an improved filter insertion and removal arrangement that allows for easy maintenance, as well as other improvements as will be described below.

BACKGROUND OF THE INVENTION

In selecting a vacuum cleaner for home use, consumers today have many choices including a choice between an upright and a canister style vacuum cleaner, a choice between a bagged or a bagless dirt collection, and, a choice between a cyclonic versus a non-cyclonic cleaning action. Typically, two very important factors in the consumer's decision regarding the purchase of a vacuum cleaner are the ease of use of the vacuum cleaner and its cleaning effectiveness. Based on these factors, the bagless style of upright vacuum cleaner has become popular recently because it no longer requires the unpleasant task of periodically changing vacuum cleaner bags. Instead, the consumer merely removes the dust cup or container and empties it over a trash receptacle. Occasionally, the consumer must also clean out a removable filter within the dust cup that traps smaller particles of dirt. One of the problems associated with the task of emptying the dust cup is that the top of the dust cup is typically open to the air thus allowing that dust previously vacuumed, can be released back into the air during the process of transporting the dust cup to the trash receptacle.

Another feature of today's bagless vacuum cleaners is that the dust cup or container is typically made of clear plastic so that the operator can observe the cleaning action of the vacuum cleaner. This visual effect lets the operator monitor the effectiveness of the cleaning action and determine when the container should be emptied or the filter cleaned. Examples of such bagless upright vacuum cleaners can be found in U.S. Pat. Nos. 6,146,434; 6,070,291; and, 5,558,697. The problem with relying on this visual assessment of the cleaning action is that most consumers may not realize when the cleaning effectiveness has deteriorated by simply viewing the cleaning action. In fact, the cleaning effectiveness is also dependent upon the condition of any filtering devices disposed in the airflow path and if such filter is clogged or dirty, the cleaning effectiveness of the vacuum cleaner can be compromised without the operator being able to visually detect such condition. Accordingly, it would be beneficial if a bagless upright vacuum cleaner provided some additional means for determining the cleaning effectiveness particularly with respect to any filter devices that may be included with the bagless vacuum cleaner.

Of further importance in the operation of such bagless vacuum cleaners is the actual task of removing and reinstalling the dirt-collecting chamber so that the dirt can be emptied into a trash receptacle. Often times the operator has to make several attempts to align the dirt-collecting chamber properly for continued operation. It would be advantageous if the bagless vacuum cleaner included a simple and easy to use arrangement for aligning and reinstalling the dirt collecting chamber following a routine exercise of emptying the chamber.

SUMMARY OF THE INVENTION

The present invention provides an improved upright vacuum cleaner having a cyclonic cleaning action with improved performance features such as a filter condition indicator that alerts the operator as to when to clean or change a filter, a simple and easy to use arrangement for removing and reinstalling the dust collecting enclosure and, a cyclone chamber that enhances the vortex force of the cyclonic cleaning action during the last stage of cyclonic filtering.

In accordance with the principles of the present invention, there is provided an upright suction cleaner which includes a floor engaging base unit, a body unit pivotally mounted on the base unit, a suction generating device which can be mounted on either the base unit or the body unit and a dirt collecting enclosure disposed on the body unit. At least one filter member is disposed in the airflow path leading from the base unit and the dirt collecting enclosure. A circuit arrangement is provided for sensing a pressure differential in the airflow across the at least one filter. If the pressure differential exceeds a predetermined threshold indicating that airflow on one side of the filter is not passing through the filter, an indicator is given to alert the operator that the filter is either dirty or clogged. The alert to the operator can be in the form of either a visual alert, for instance, an LED, or, an audio alert such as an alarm.

In another embodiment of the invention, there is provided a simple and easy to use method of removing and reinstalling the dirt collecting enclosure. In this embodiment, the dirt collecting enclosure rests on an elevator device that can be raised or lowered by operation of a lever disposed at the front of the upright suction cleaner. Lowering the elevator arrangement allows the operator to easily remove the dirt collecting enclosure by grasping the handle, which in one embodiment, is formed by one of the chambers associated with the dirt collecting enclosure. Additionally, operation of the elevator arrangement is effective for unsealing the seals in the airflow path when in the lowered position, and, aligning and resealing the seals when the elevator is again raised into the operating position.

In yet another embodiment of the invention, there is provided an improved cyclonic cleaning action wherein, during a first stage of cleaning, the largest particles of debris are separated out of the airflow path and deposited into a first chamber, the next largest particles of debris are separated out of the airflow path and deposited in a second chamber. Additionally, following passage of the airflow through a cyclonic chamber disposed above and transverse to the dirt collecting enclosure, the finest particles of debris are passed to and captured by a filter disposed in a third chamber to thereby complete the cleaning process.

BRIEF DESCRIPTION OF THE DRAWINGS

The invention will now be more fully described with reference to the accompanying drawings in which.

DETAILED DESCRIPTION OF THE INVENTION

Figure 1:
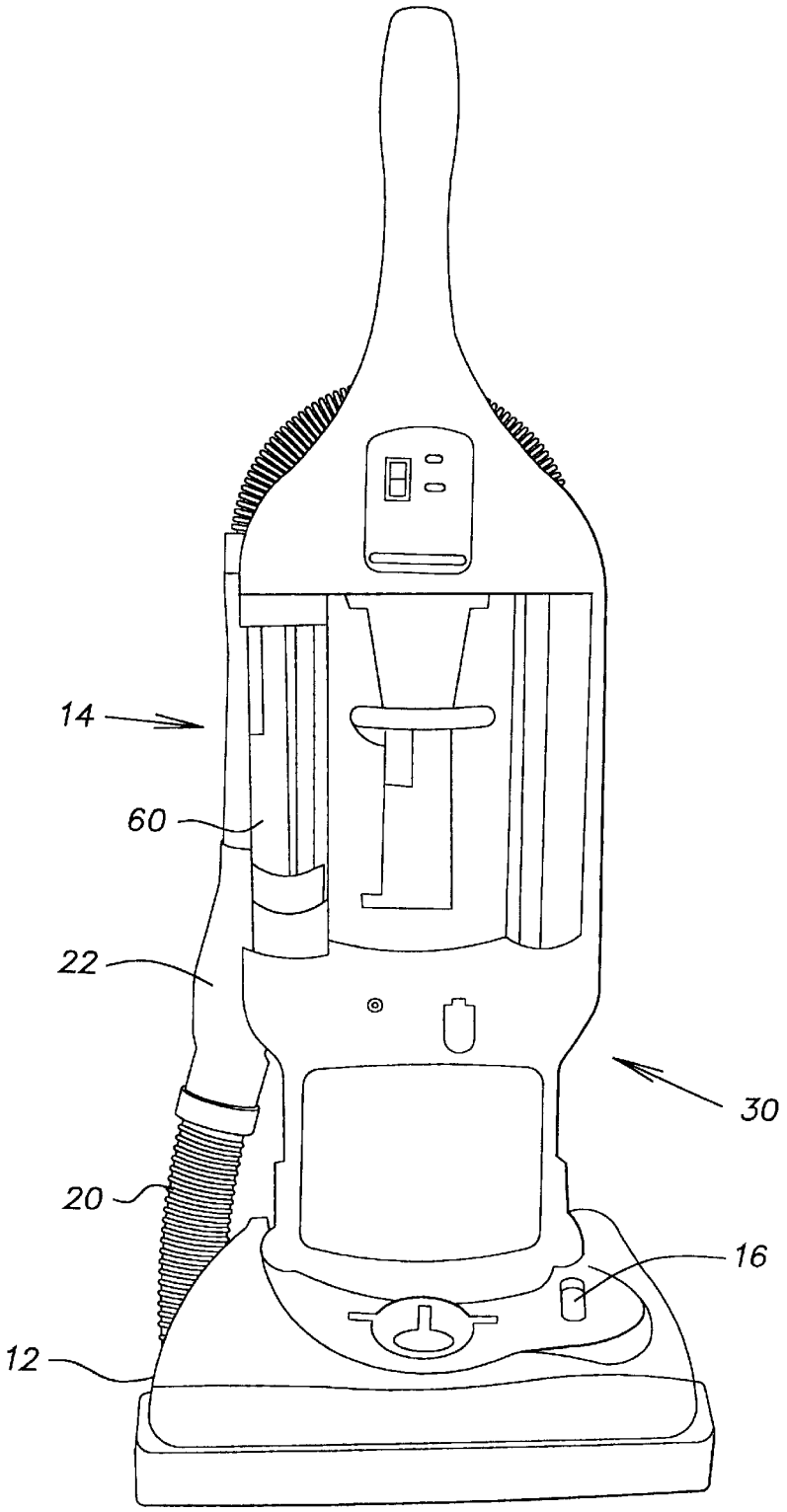
FIG. 1 is a perspective view of a front of the vacuum cleaner constructed in accordance with the present invention.

The present invention is directed toward an improved upright vacuum cleaner that has a plurality of cyclone filtration chambers and other mechanical filter means. The present invention uses progressive filtration wherein larger particles are removed first and then progressively smaller particles are removed from the air stream until, finally, very small particles are removed. As seen in FIG. 1, the vacuum cleaner of the present invention has a base 12, a rear housing 14 and an upstanding handle (see FIG. 3). The handle can be packaged separate and apart from the rear housing 14 and can be easily assembled by the user. The handle 10 includes a yoke or laterally split attachment arms that are inserted into accommodating recesses in the rear housing 14.

Figure 2:
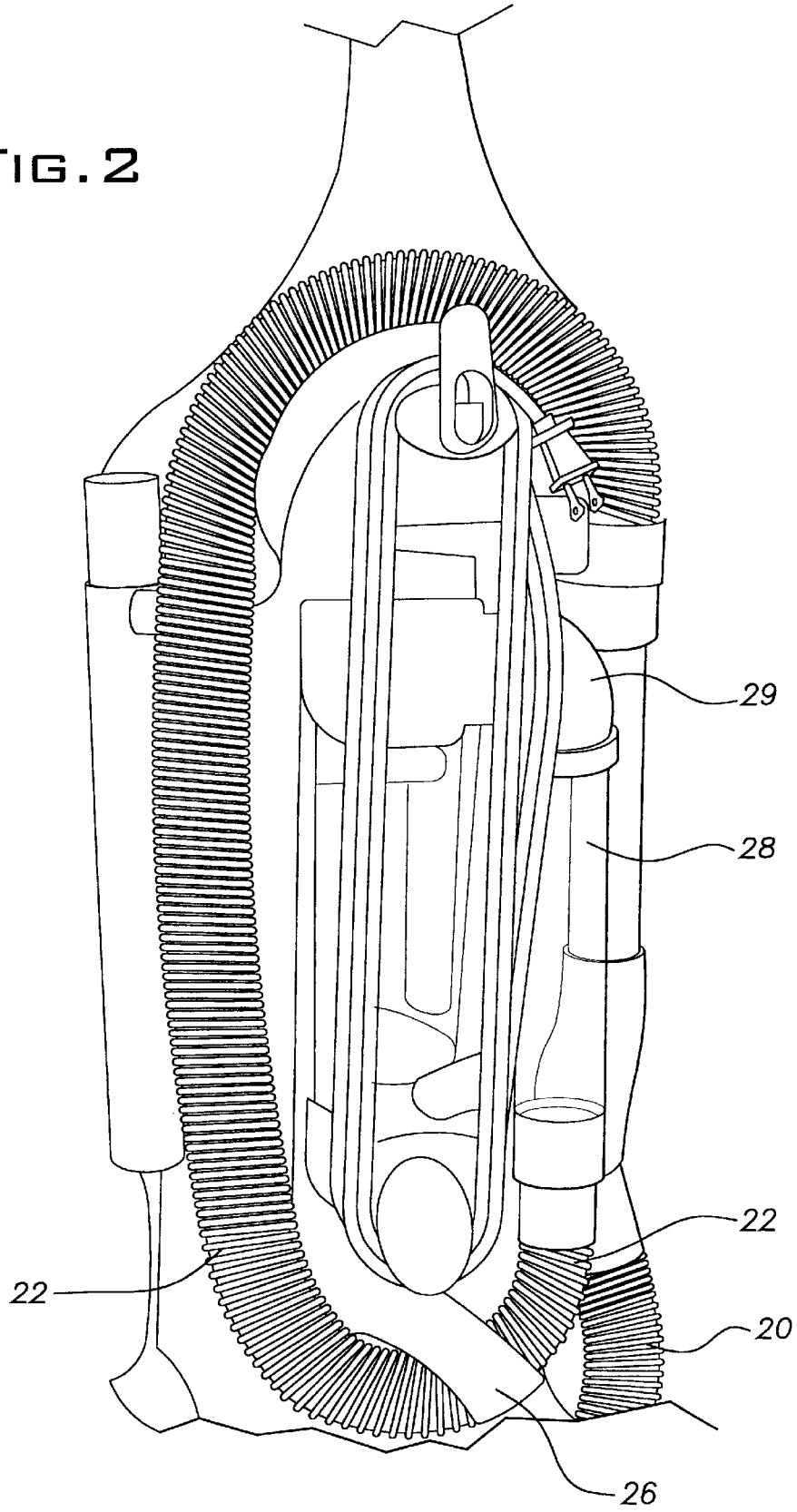
FIG. 2 is a perspective view of a rear of the vacuum cleaner constructed in accordance with the present invention.
Figure 3:
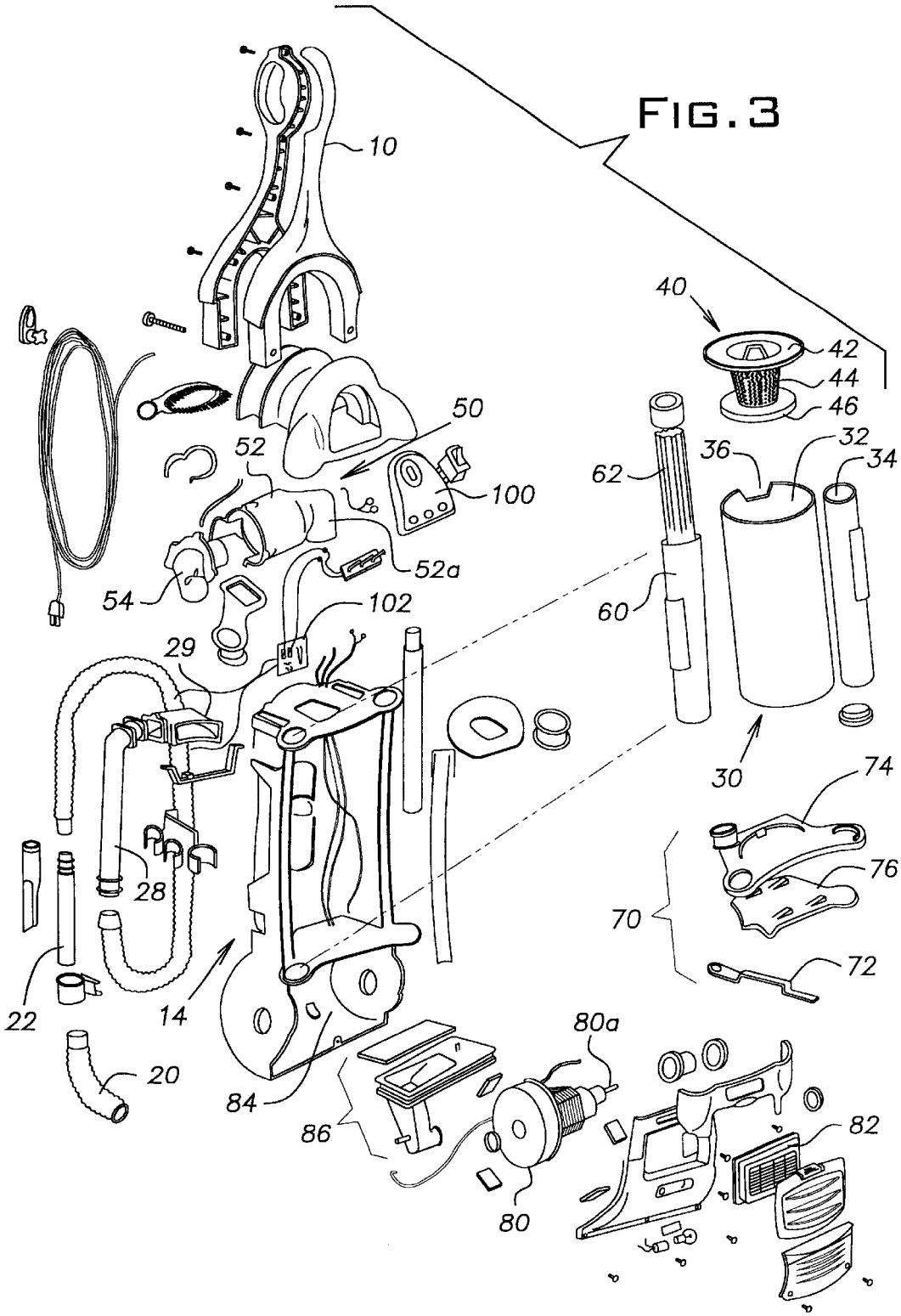
FIG. 3 is an exploded perspective view of the vacuum cleaner according to the present invention.

The base 12 includes a brush roll (not shown) that is selectively rotated by a drive belt (not shown), such brush roll and drive belt being constructed according to well known techniques. The drive belt is driven by a shaft 80*a* off of motor/fan assembly 80 as shown in FIG. 3. The motor/fan assembly 80 can be disposed in a bottom portion of the rear housing 14, which is rotatably connected to the base 12. Additionally, the motor/fan assembly 80 can be disposed in a plenum chamber 84 created by the air duct and rear housing/motor cover seal 86. The drive belt may be engaged/disengaged from the brush roll by operation of a pulley via a slide lever 16 to thereby disengage the brush roll as is desired when cleaning hard floor surfaces. As seen more clearly in FIG. 2, a tube 20 extends from the base 12 and communicates air and dirt upwardly from the base 12 to a hose 22. The hose 22 extends upwardly from the tube connection around a hose hook of a top rear portion of the rear housing 14 and down to the base of the rear housing 14 and under a hose retention member 26. The free end of the hose 22 connects to a first end of a conduit 28. The second end of the conduit 28 is connected to a dirt sensor housing 29.

The dirt sensor housing 29 extends from the conduit 28 to a rear portion of a dirt collecting enclosure 30 and acts as an input port so as to be sealingly engaged to the rear of the dirt collecting enclosure 30. The dirt sensor housing 29 can have gaskets molded or installed therein. Additionally, the dirt sensor housing 29 is formed having a bend therein so as to extend from a downwardly facing inlet to a laterally or horizontally facing outlet that is then connected to the rear portion of the dirt collecting enclosure 30. It would also be possible to achieve the benefits of the present invention if the inlet to the dirt sensor housing 29 were disposed in a horizontally; that is, oriented in the same manner as the horizontally facing outlet.

Figure 5:
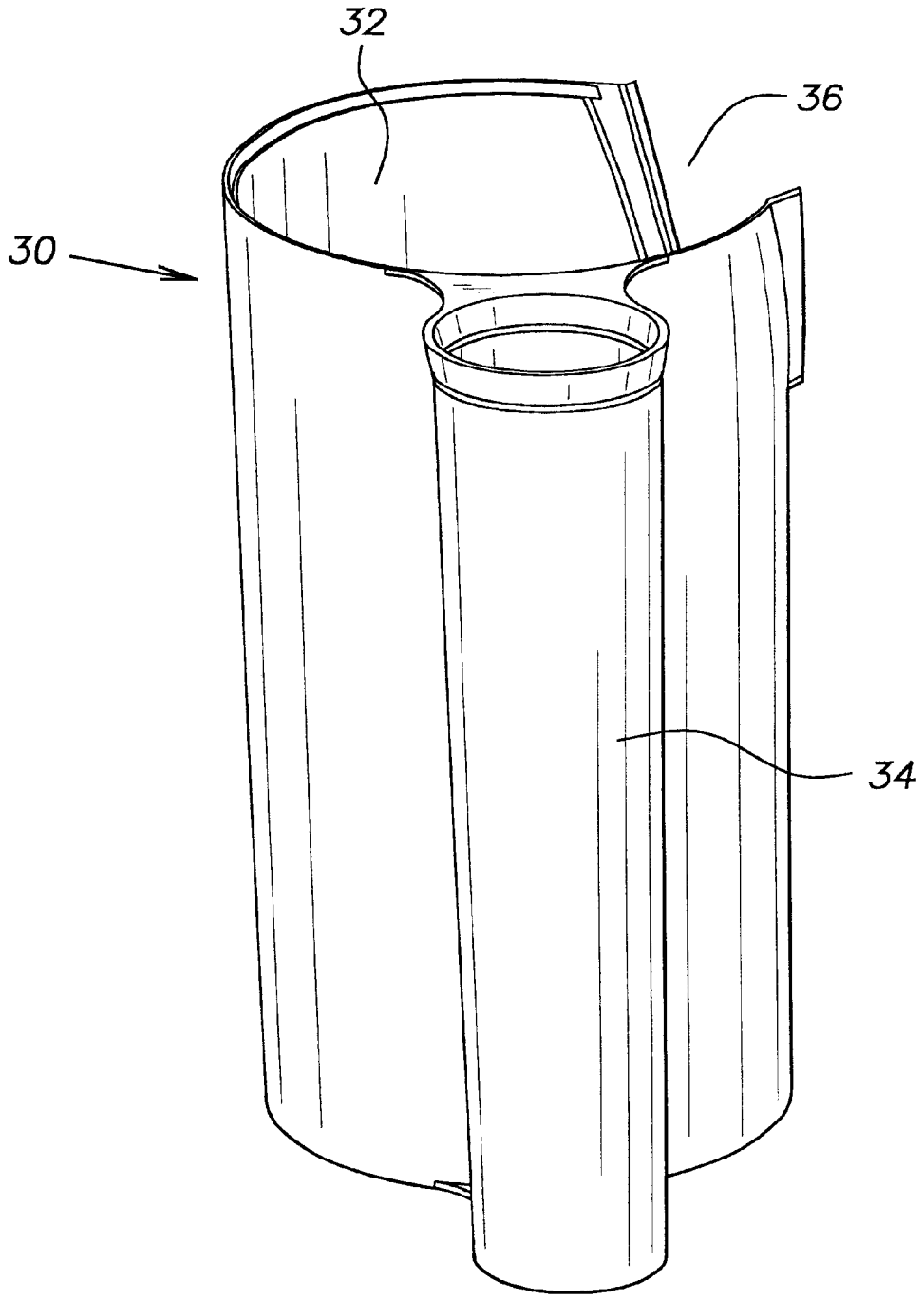
FIG. 5 is a perspective view of the dirt collecting enclosure portion of the present invention.

As seen in FIG. 5, the dirt collecting enclosure 30 has a first large chamber 32 and a smaller chamber 34. Air and dirt are introduced into the first large chamber 32 in a tangential manner to thereby achieve a cyclonic airflow. Each of the first and second chambers 32, 34 has an open upper end and a closed bottom side. The dirt sensor housing 29 sealingly engages a side of the large chamber 32 at a top end thereof and surrounds an input opening 36 to the large chamber 32. The input opening 36 is a notched opening at the top end of the first large chamber 32. Of course, the input opening to the first large chamber 32 can be disposed in the side of the large chamber 32 thereby allowing that the upper edge of the first large chamber is continuous about its circumference. An upper edge of the dirt collecting enclosure 30 at the first large chamber 32 includes a rim or ledge. A filter element 40 is disposed in the first large chamber 32 and is laterally adjacent the input opening 36.

Figure 6:
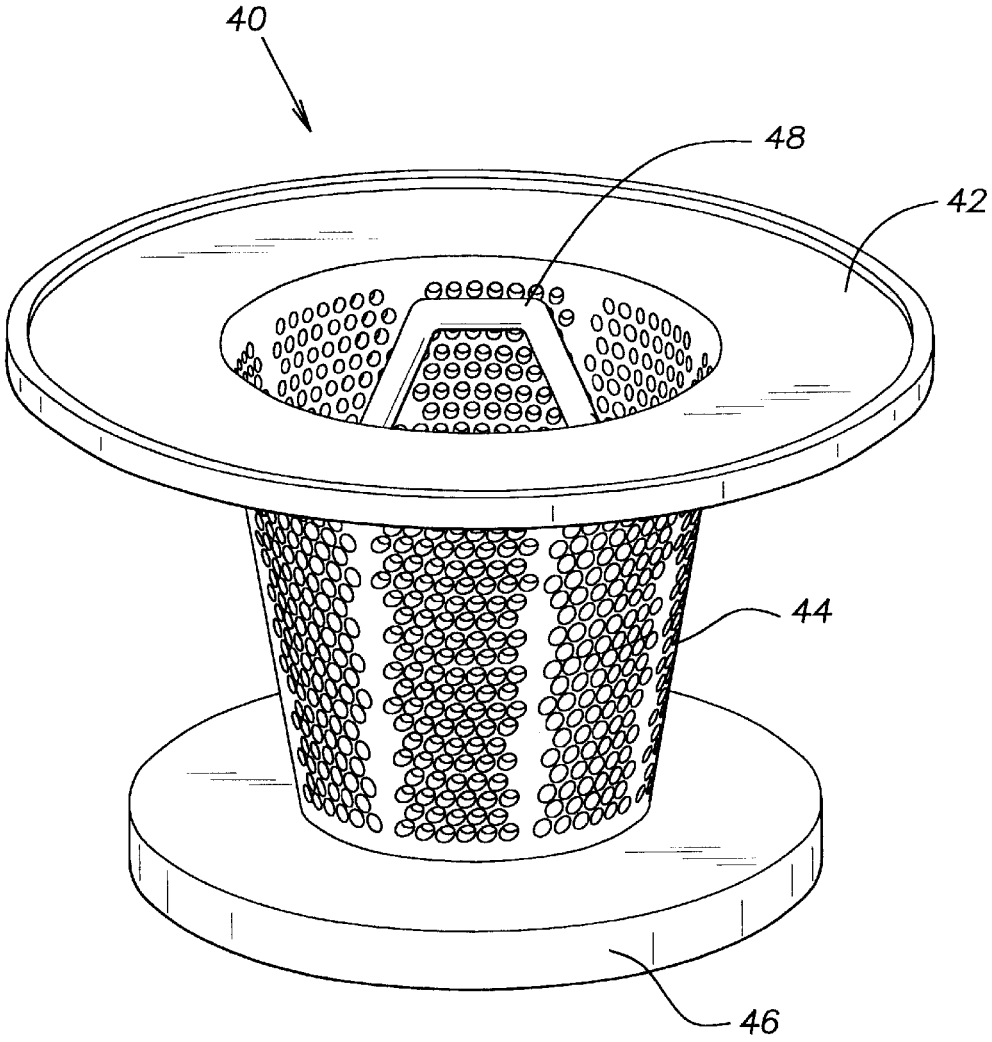
FIG. 6 is a perspective view of the filter element portion of the present invention.

As seen in FIG. 6, the filter element 40 includes an upper ring-shaped circular portion 42, a central frustoconical portion 44; and a lower ring-shaped portion 46. The upper ring-shaped portion 42 rests or is seated on the ring or ledge of the large first chamber 32 so that the body of filter 40 extends into the large first chamber 32. It should be noted that the upper ring-shaped portion 42 of filter 40 is effective for essentially closing off the large first chamber 32. This is particularly effective during the process of emptying the dirt collecting enclosure 30 in that the seating of the filter 40 of the upper opening of the first chamber 32 substantially reduces the occurrence of dirt escaping the dirt collecting enclosure 30 when the user is emptying the dirt collecting enclosure 30 into a trash receptacle. In this manner, the filter 40 acts as both a filter and a seal.

Figure 7:
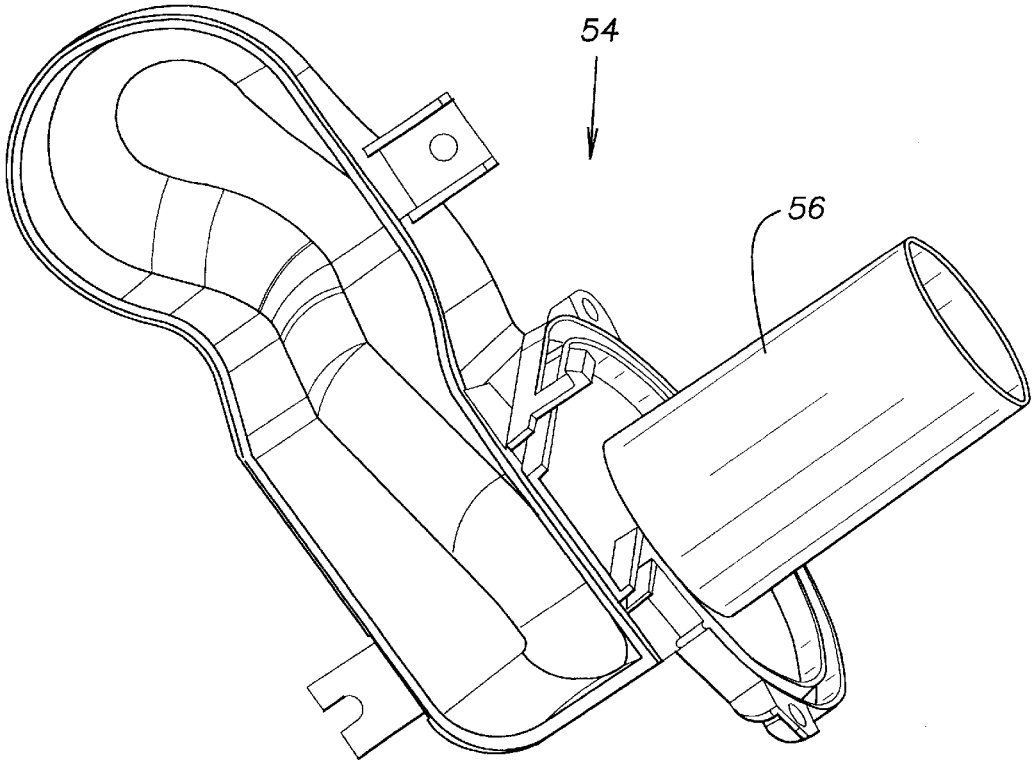
FIG. 7 is a perspective view of the end cap portion of the cyclone body of the present invention.
Figure 8:
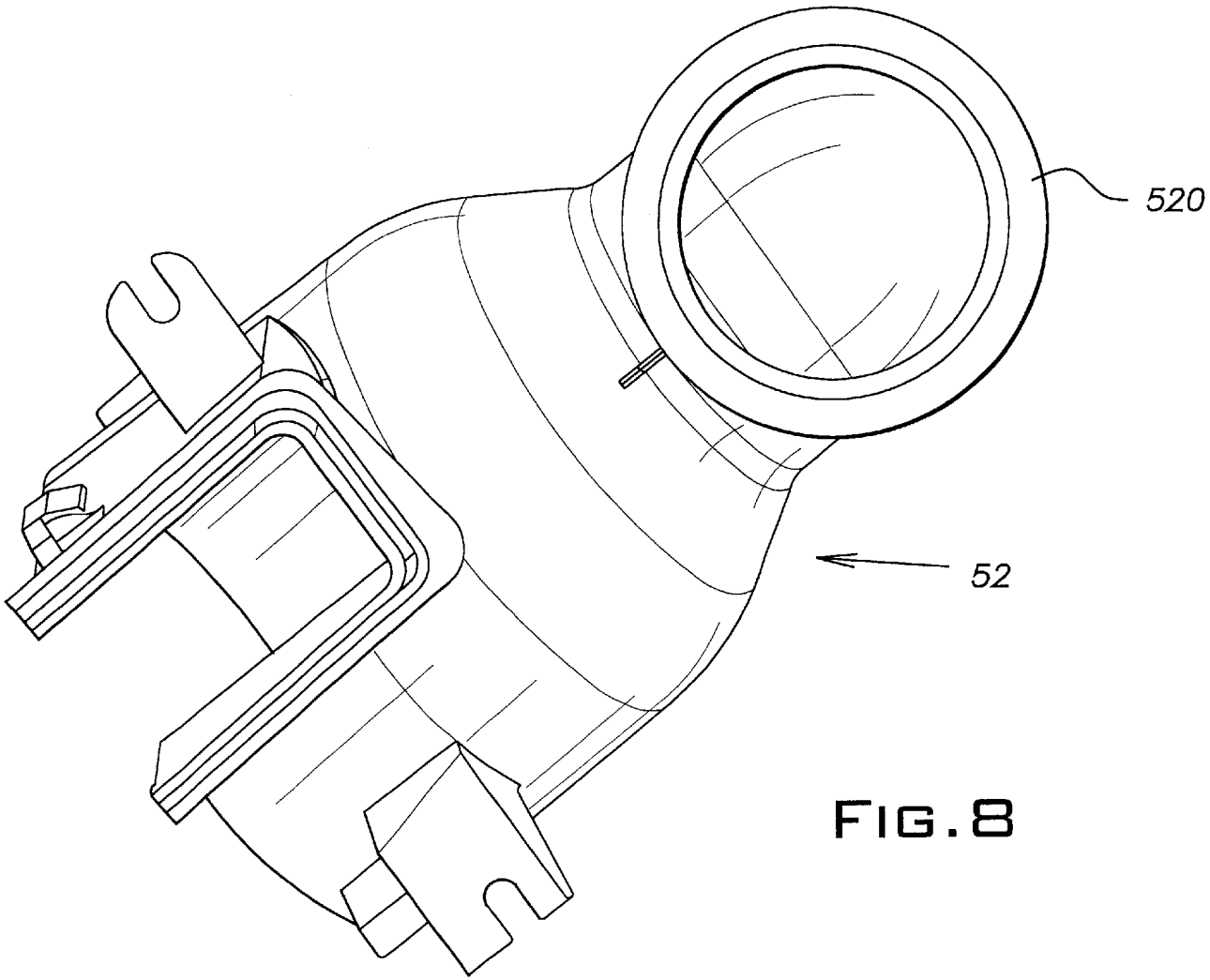
FIG. 8 is a perspective view of the cyclone body of the present invention.

The frustoconical portion 44 is perforated and serves as a filter surface. The lower ring shaped portion 46, which includes a downwardly extending peripheral flange, serves as a baffle plate and separator for larger particles that precipitate into the bottom of the first large chamber 32. Air from the first large chamber 32 flows through the filter member 40 and upwardly into a second cyclone 50 (see FIG. 3). The second cyclone is disposed relatively above the dirt collecting enclosure 30 and is operable to deposit or direct smaller dirt particles into the second chamber 34 of the dirt collecting enclosure 30. More specifically, relatively clean air from the first chamber 32 tangentially enters the second cyclone 50 and the cyclone chamber provided thereby via an inlet defined by the union of the cyclone body 52 and the cyclone end cap 54 (see FIGS. 7 and 8).

The cyclone body 52 includes a circular first body portion that merges into a downwardly extending tube portion 52*a*. The end of the tube portion 52*a* includes a flange and a neck, the neck extending into and sealing the second chamber 34 with the flange abutting the end face of the second chamber 34. Air is introduced tangentially into the second cyclone 50 and spirals around the neck and downwardly into the bottom of the second chamber 34 so as to carry the smaller particles of debris therewith. The clean air from the second chamber 34 exits via the outlet tube 56 provided by the cyclone end cap 54 and flows laterally across the vacuum cleaner body and into the top end of filter tube 60. The filter tube 60 is disposed substantially symmetrically on the opposite side of the first chamber 32 as the second chamber 34. More specifically, the air that enters a cylindrical filter member 62 disposed within filter tube 60, flows through the filter element 62 and exits via an outlet at the bottom of the filter tube 60. Air is communicated from the outlet of the filter tube 60 to the motor/fan assembly 80 and then to atmosphere via a HEPA filter 82.

As seen in FIG. 3, the vacuum cleaner includes an elevator assembly 70 that permits easy installation and sealing engagement of the dirt collecting enclosure 30 and filter tube 60 with the rear housing 14. The elevator assembly 70 is mounted to the rear housing 14 relatively beneath the dirt collecting enclosure 30 and filter tube 60 and includes a handle 72 that is laterally shifted or pivoted. Of course, other actuation mechanisms can be utilized as well and still achieve the benefits of the present invention. For instance, a rotatable knob can achieve the same actuation effect as the lever or handle 72. Movement of the handle 72 causes an elevator platform 74 to be moved up or down thereby either pushing the dirt collecting enclosure 30 and filter tube 60 up into sealing engagement with associated upper seals, or, permits the dirt collecting enclosure 30 and filter tube 60 to be dropped down and out of sealing engagement with the seals. Typically, the elevator assembly 70 will be moved to a lower position to permit removal of the dirt collecting enclosure 30 from the rear housing 14 for emptying, and will be moved to the upper position after the dirt collecting enclosure 30 and filter tube 60 are reinstalled to seal the assembly in position and permit further cleaning operations. A cam plate can also be provided as part of the elevator assembly 70 to achieve the raising and lowering functions. Of course, the cam operation need not be provided by a separate element but can be achieved by providing a camming surface on either the elevator platform 74 or the lever member 72. Additionally, though the present embodiment describes a mechanical arrangement for actuating the elevator, it is contemplated herein that the elevator arrangement could also be achieved by use of an electrical or pneumatic form of actuation.

The cyclone body 52 and cyclone end cap 54 cooperate to filter dirt from air and to transport clean air to another location for further processing. In this regard, it is important to note that the cyclone body 52 and the cyclone end cap 54 do not require a replaceable and removable filter element. The cyclone chamber defined by the cyclone body 52 is angled with respect to vertical, and extends downwardly and laterally from the upper end to the lower end. The lower end of the cyclone chamber bends still further downwardly such that the exit of the tube is essentially vertically oriented and therefore matches the orientation of the second chamber 34 and smoothly merges therewith.

The cyclone body 52 has a first edge adjacent its upper end that is engaged and sealed by the cyclone end cap 54. The cyclone end cap 54 preferably has a peripheral groove into which the first edge is inserted to form a labyrinth type seal. Naturally, additional sealing gaskets or seals may also be used. The connection between the cyclone end cap 54 and the cyclone body 52 also defines the inlet air passageway from the first chamber 32/filter element 40 to the second cyclone as noted hereinbefore. The end cap 52 and body 54 are also attached by cooperation of tabs and mechanical fasteners (not shown) about the first edge and the peripheral groove to ensure a sealing connection. The inlet passageway is generally tangential to the inner wall surface of the cyclone body 52, as illustrated.

Figure 4:
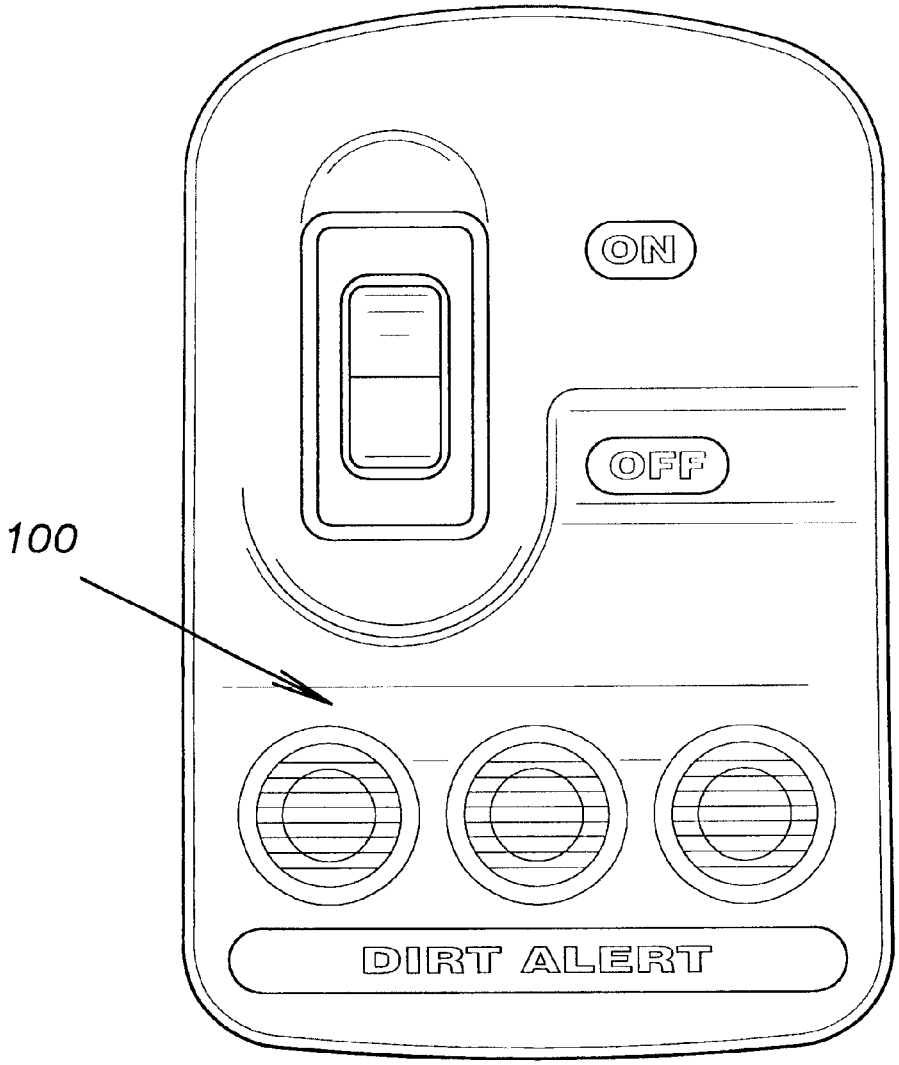
FIG. 4 is a front elevational view of a front of a vacuum cleaner showing dirt and filter condition indicators.

As seen in FIG. 4, adjacent the on-off switch, a series of indicator 100 are provided. The indicators can be LEDs that are illuminated to indicate the occurrence of a differential pressure across one or more of the filter elements, which is indicative of a clogged or dirty filter. The filter elements being sensed are preferably the HEPA filter and/or the tube filter element 62 downstream of the cyclone filter units. A circuit board 102 (see FIG. 3) with sensors extending therefrom into the airflow path, can perform the necessary detection and indication functions according to known techniques.

Although the hereinabove described embodiment of the invention constitutes the preferred embodiment; it should be understood that modifications could be made thereto without departing from the scope of the invention as set forth in the appended claims.

What is claimed is:

1. An upright suction cleaner comprising:

a floor engaging base unit;

a body unit pivotally mounted on the base unit;

a suction generating device disposed on one of said base unit and body unit;

a dirt collecting enclosure disposed on said body unit, said dirt collecting enclosure having a first and a second chamber formed therein;

an inlet port cooperatively engaging a portion of said first chamber, said inlet port allowing communication of airflow into said first chamber;

a first filter member disposed in said first chamber and operating in conjunction with said inlet port for imparting to such airflow communicated thereto, a vortex action;

wherein said first filter member is effective so as to remove from such airflow, particles of debris of a larger size and deposit such larger sized debris into said first chamber, said first filter member is further effective for communicating therethrough into said second chamber, the remaining airflow from said first chamber;

wherein such remaining airflow from said first chamber, while still having associated therewith, a cyclonic action, deposits into said second chamber, debris of a size smaller than that which was deposited in said first chamber;

a cyclone chamber disposed above said dirt collecting enclosure, said cyclone chamber effective for communicating airflow remaining from said second chamber, into a third chamber, said cyclone chamber further effective for imparting additional cyclonic action to said remaining airflow; and, a second filter member disposed in said third chamber, said second filter member being effective for removing from said remaining airflow, debris of a size smaller than that removed by said second chamber;

wherein said second chamber is a tube disposed at one side of said first chamber and further wherein said second chamber is of a diameter substantially smaller than the diameter of said first chamber so that, when gripped, said second chamber acts as a handle for transport of said dirt collecting enclosure.

2. An upright suction cleaner as set forth in claim 1 wherein said first, second and third chambers are constructed of clear plastic material.

3. An upright suction cleaner as set forth in claim 1 wherein said first filter member further includes a handle portion disposed on the inside thereof.

4. An upright suction cleaner as set forth in claim 1 wherein said cyclone chamber is disposed at a downward inclination along a lateral extent of the cyclone chamber.

5. An upright suction cleaner comprising:

a floor engaging base unit;

a body unit pivotally mounted on the base unit;

a suction generating device disposed on one of said base unit and body unit;

a dirt collecting enclosure disposed on said body unit, said dirt collecting enclosure having a first and a second chamber formed therein;

an inlet port cooperatively engaging a portion of said first chamber, said inlet port allowing communication of airflow into said first chamber;

a first filter member disposed in said first chamber and operating in conjunction with said inlet port for imparting to such airflow communicated thereto, a vortex action;

wherein said first filter member is effective so as to remove from such airflow, particles of debris of a larger size and deposit such larger sized debris into said first chamber, said first filter member is further effective for communicating therethrough into said second chamber, the remaining airflow from said first chamber;

wherein such remaining airflow from said first chamber, while still having associated therewith, a cyclonic action, deposits into said second chamber, debris of a size smaller than that which was deposited in said first chamber;

a cyclone chamber disposed above said dirt collecting enclosure, said cyclone chamber effective for communicating airflow remaining from said second chamber, into a third chamber, said cyclone chamber further effective for imparting additional cyclonic action to said remaining airflow; and, a second filter member disposed in said third chamber, said second filter member being effective for removing from said remaining airflow, debris of a size smaller than that removed by said second chamber;

wherein said first filter member has an upper ridge portion that, when seated over an upper opening associated with said first chamber, substantially encloses said upper opening of said first chamber.

6. An upright suction cleaner as set forth in claim 5 wherein said first filter member has a center portion which is perforated and is frusto-conical in shape, said first filter member further having a lower ledge portion connected to the bottom of said center portion of said first filter member.

7. An upright suction cleaner as set forth in claim 6 wherein said first filter member further includes a handle portion disposed on the inside thereof.

8. An upright suction cleaner as set forth in claim 5 wherein said first filter member further includes a handle portion disposed on the inside thereof.

9. An upright suction cleaner as set forth in claim 5 wherein said first, second and third chambers are constructed of clear plastic material.

10. An upright suction cleaner as set forth in claim 5 wherein said cyclone chamber is disposed at a downward inclination along a lateral extent of the cyclone chamber.

11. An upright suction cleaner comprising:

a floor engaging base unit;

a body unit pivotally mounted on the base unit;

a suction generating device disposed on one of said base unit and body unit;

a dirt collecting enclosure disposed on said body unit, said dirt collecting enclosure having a first and a second chamber formed therein;

an inlet port cooperatively engaging a portion of said first chamber, said inlet port allowing communication of airflow into said first chamber;

a first filter member disposed in said first chamber and operating in conjunction with said inlet port for imparting to such airflow communicated thereto, a vortex action;

wherein said first filter member is effective so as to remove from such airflow, particles of debris of a larger size and deposit such larger sized debris into said first chamber, said first filter member is further effective for communicating therethrough into said second chamber, the remaining airflow from said first chamber;

wherein such remaining airflow from said first chamber, while still having associated therewith, a cyclonic action, deposits into said second chamber, debris of a size smaller than that which was deposited in said first chamber;

a cyclone chamber disposed above said dirt collecting enclosure, said cyclone chamber effective for communicating airflow remaining from said second chamber, into a third chamber, said cyclone chamber further effective for imparting additional cyclonic action to said remaining airflow; and, a second filter member disposed in said third chamber, said second filter member being effective for removing from said remaining airflow, debris of a size smaller than that removed by said second chamber;

wherein said cyclone chamber is disposed transversely and above said dirt collecting chamber and extends from said second chamber to said third chamber.

12. An upright suction cleaner as set forth in claim 11 wherein said cyclone chamber includes a main body portion and an end cap portion having formed at one end thereof, an outlet tube effective for allowing communication of said remaining airflow from said second chamber into said third chamber.

13. An upright suction cleaner as set forth in claim 12 wherein said cyclone is disposed at a downward inclination along a lateral extent of the cyclone chamber.

14. An upright suction cleaner as set forth in claim 11 wherein said cyclone chamber is disposed at a downward inclination along a lateral extent of the cyclone chamber.

15. An upright suction cleaner as set forth in claim 11 wherein said first filter member further includes a handle portion disposed on the inside thereof.

16. An upright suction cleaner as set forth in claim 11 wherein said first, second and third chambers are constructed of clear plastic material.

17. An upright suction cleaner comprising:

a floor engaging base unit;

a body unit pivotally mounted on the base unit;

a suction generating device disposed on one of said base unit and body unit;

a dirt collecting enclosure disposed on said body unit, said dirt collecting enclosure having a first and a second chamber formed therein;

an inlet port cooperatively engaging a portion of said first chamber, said inlet port allowing communication of airflow into said first chamber;

a first filter member disposed in said first chamber and operating in conjunction with said inlet port for imparting to such airflow communicated thereto, a vortex action;

wherein said first filter member is effective so as to remove from such airflow, particles of debris of a larger size and deposit such larger sized debris into said first chamber, said first filter member is further effective for communicating therethrough into said second chamber, the remaining airflow from said first chamber;

wherein such remaining airflow from said first chamber, while still having associated therewith, a cyclonic action, deposits into said second chamber, debris of a size smaller than that which was deposited in said first chamber;

a cyclone chamber disposed above said dirt collecting enclosure, said cyclone chamber effective for communicating airflow remaining from said second chamber, into a third chamber, said cyclone chamber further effective for imparting additional cyclonic action to said remaining airflow; and, a second filter member disposed in said third chamber, said second filter member being effective for removing from said remaining airflow, debris of a size smaller than that removed by said second chamber;

wherein said suction generating device is a motor/fan assembly disposed within a plenum chamber formed at the bottom portion of said body unit by a bottom housing portion of said body unit, a motor cover seal and an air duct member.

18. An upright suction cleaner as set forth in claim 17 wherein said first filter member further includes a handle portion disposed on the inside thereof.

19. An upright suction cleaner as set forth in claim 17 wherein said first, second and third chambers are constructed of clear plastic material.

20. An upright suction cleaner as set forth in claim 17 wherein said cyclone chamber is disposed at a downward inclination along a lateral extent of the cyclone chamber.

21. An upright suction cleaner comprising:

a floor engaging base unit;

a body unit pivotally mounted on said base unit;

a suction generating device disposed on one of said base unit and said body unit;

a dirt collecting enclosure portion disposed on said body unit, said dirt collecting enclosure portion having first and second laterally-disposed chambers;

an inlet port cooperating with said first chamber to direct a debris-laden airflow into said first chamber and operating in conjunction with said first chamber to cause an airflow vortex within said first chamber;

a first filter member disposed in said first chamber, said first filter member permitting passage of airflow out from said first chamber and retaining at least some debris particles within said first chamber;

a cyclone chamber disposed above said dirt collecting enclosure portion and operatively connected to receive airflow passing upward, out of said first chamber, said cyclone chamber having one end operatively connected to an upper end of said second chamber, said cyclone chamber cooperating with said second chamber to cause at least some debris to be deposited within said second chamber;

a third chamber disposed below said cyclone chamber and operatively connected to said cyclone chamber to receive an air flow downward, out of said cyclone chamber;

a second filter member disposed within said third chamber, said second filter member retaining at least some debris particles within said third chamber; and wherein said second chamber is disposed at one side of and is of a diameter substantially smaller than the diameter of said first chamber so that, when gripped, said second chamber acts as a handle for transport of said dirt collecting enclosure portion.

22. An upright suction cleaner as set forth in claim 21 wherein said first, second and third chambers are constructed of clear plastic material.

23. An upright suction cleaner as set forth in claim 21 wherein said first filter member further includes a handle portion disposed on the inside thereof.

24. An upright suction cleaner as set forth in claim 21 wherein said cyclone chamber is disposed at a downward inclination along a lateral extent of the cyclone chamber.

25. An upright suction cleaner as set forth in claim 21 wherein said cyclone chamber is disposed transversely relative to said dirt collecting enclosure portion and extends from said second chamber to said third chamber.

26. An upright suction cleaner as set forth in claim 25 wherein said first filter member has an upper ring-shaped portion that, when seated over an upper opening associated with said first chamber, substantially encloses said upper opening of said first chamber.

27. An upright suction cleaner comprising:

a floor engaging base unit;

a body unit pivotally mounted on said base unit;

a suction generating device disposed on one of said base unit and said body unit;

a dirt collecting enclosure portion disposed on said body unit, said dirt collecting enclosure portion having first and second laterally-disposed chambers;

an inlet port cooperating with said first chamber to direct a debris-laden airflow into said first chamber and operating in conjunction with said first chamber to cause an airflow vortex within said first chamber;

a first filter member disposed in said first chamber, said first filter member permitting passage of airflow out from said first chamber and retaining at least some debris particles within said first chamber;

a cyclone chamber disposed above said dirt collecting enclosure portion and operatively connected to receive airflow passing upward, out of said first chamber, said cyclone chamber having one end operatively connected to an upper end of said second chamber, said cyclone chamber cooperating with said second chamber to cause at least some debris to be deposited within said second chamber;

a third chamber disposed below said cyclone chamber and operatively connected to said cyclone chamber to receive an air flow downward, out of said cyclone chamber a second filter member disposed within said third chamber, said second filter member retaining at least some debris particles within said third chamber; and wherein said first filter member has an upper ring shaped portion that, when seated over an upper opening associated with said first chamber, substantially encloses said upper opening of said first chamber.

28. An upright suction cleaner as set forth in claim 27 wherein said first filter member has a center portion which is perforated and is frusto-conical in shape, said first filter member further having a lower ledge portion connected to the bottom of said center portion of said first filter member.

29. An upright suction cleaner as set forth in claim 28 wherein said first filter member further includes a handle portion disposed on the inside thereof.

30. An upright suction cleaner as set forth in claim 27 wherein said first filter member further includes a handle portion disposed on the inside thereof.

31. An upright suction cleaner as set forth in claim 27 wherein said first, second and third chambers are constructed of clear plastic material.

32. An upright suction cleaner as set forth in claim 27 wherein said cyclone chamber is disposed at a downward inclination along a lateral extent of the cyclone chamber.

33. An upright suction cleaner as set forth in claim 27 wherein said cyclone chamber is disposed transversely relative to said dirt collecting enclosure portion and extends from said second chamber to said third chamber.

34. An upright suction cleaner comprising:

a floor engaging base unit;

a body unit pivotally mounted on said base unit;

a suction generating device disposed on one of said base unit and said body unit;

a dirt collecting enclosure portion disposed on said body unit, said dirt collecting enclosure portion having first and second laterally-disposed chambers;

an inlet port cooperating with said first chamber to direct a debris-laden airflow into said first chamber and operating in conjunction with said first chamber to cause an airflow vortex within said first chamber;

a first filter member disposed in said first chamber, said first filter member permitting passage of airflow out from said first chamber and retaining at least some debris particles within said first chamber;

a cyclone chamber disposed above said dirt collecting enclosure portion and operatively connected to receive airflow passing upward, out of said first chamber, said cyclone chamber having one end operatively connected to an upper end of said second chamber, said cyclone chamber cooperating with said second chamber to cause at least some debris to be deposited within said second chamber;

a third chamber disposed below said cyclone chamber and operatively connected to said cyclone chamber to receive an air flow downward, out of said cyclone chamber;

a second filter member disposed within said third chamber, said second filter member retaining at least some debris particles within said third chamber; and wherein said cyclone chamber is disposed transversely relative to said dirt collecting enclosure portion and extends from said second chamber to said third chamber.

35. An upright suction cleaner as set forth in claim 34 wherein said cyclone chamber includes a main body portion and an end cap portion having formed at one end thereof, an outlet tube effective for allowing communication of said remaining airflow from said second chamber into said third chamber.

36. An upright suction cleaner as set forth in claim 35 wherein said cyclone chamber is disposed at a downward inclination along a lateral extent of the cyclone chamber.

37. An upright suction cleaner as set forth in claim 34 wherein said cyclone chamber is disposed at a downward inclination along a lateral extent of the cyclone chamber.

38. An upright suction cleaner as set forth in claim 34 wherein said first filter member further includes a handle portion disposed on the inside thereof.

39. An upright suction cleaner as set forth in claim 34 wherein said first, second and third chambers are constructed of clear plastic material.

40. An upright suction cleaner comprising:

a floor engaging base unit;

a body unit pivotally mounted on said base unit;

a suction generating device disposed on one of said base unit and said body unit;

a dirt collecting enclosure portion disposed on said body unit, said dirt collecting enclosure portion having first and second laterally-disposed chambers;

an inlet port cooperating with said first chamber to direct a debris-laden airflow into said first chamber and operating in conjunction with said first chamber to cause an airflow vortex within said first chamber;

a first filter member disposed in said first chamber, said first filter member permitting passage of airflow out from said first chamber and retaining at least some debris particles within said first chamber;

a cyclone chamber disposed above said dirt collecting enclosure portion and operatively connected to receive airflow passing upward, out of said first chamber, said cyclone chamber having one end operatively connected to an upper end of said second chamber, said cyclone chamber cooperating with said second chamber to cause at least some debris to be deposited within said second chamber;

a third chamber disposed below said cyclone chamber and operatively connected to said cyclone chamber to receive an air flow downward, out of said cyclone chamber;

a second filter member disposed within said third chamber, said second filter member retaining at least some debris particles within said third chamber; and wherein said cyclone chamber is disposed transversely relative to said dirt collecting enclosure portion and extends from said second chamber to said third chamber.

41. An upright suction cleaner as set forth in claim 40 wherein said first filter member further includes a handle portion disposed on the inside thereof.

42. An upright suction cleaner as set forth in claim 40 wherein said first, second and third chambers are constructed of clear plastic material.

43. An upright suction cleaner as set forth in claim 40 wherein said cyclone chamber is disposed at a downward inclination along a lateral extent of the cyclone chamber.

44. An upright suction cleaner comprising:

a floor engaging base unit;

a body unit pivotally mounted on said base unit;

a suction generating device disposed on one of said base unit and said body unit;

a dirt collecting enclosure portion disposed on said body unit, said dirt collecting enclosure portion having first and second laterally-disposed chambers;

an inlet port cooperating with said first chamber to direct a debris-laden airflow into said first chamber and operating in conjunction with said first chamber to cause an airflow vortex within said first chamber;

a first filter member disposed in said first chamber, said first filter member permitting passage of airflow out from said first chamber and retaining at least some debris particles within said first chamber;

a cyclone chamber disposed above said dirt collecting enclosure portion and operatively connected to receive airflow passing upward, out of said first chamber, said cyclone chamber having one end operatively connected to an upper end of said second chamber, said cyclone chamber cooperating with said second chamber to cause at least some debris to be deposited within said second chamber;

a third chamber disposed below said cyclone chamber and operatively connected to said cyclone chamber to receive an air flow downward, out of said cyclone chamber;

a second filter member disposed within said third chamber, said second filter member retaining at least some debris particles within said third chamber; and wherein said suction generating device has a motor/fan assembly disposed within a plenum chamber at a bottom portion of said body unit, the plenum chamber being formed by a bottom housing portion of said body unit, a motor cover seal, and an air duct member.

* * * * *

UNITED STATES PATENT AND TRADEMARK OFFICE

CERTIFICATE OF CORRECTION

PATENT NO. : 6,910,245 B2
APPLICATION NO. : 09/759391
DATED : June 28, 2005
INVENTOR(S) : Hawkins et al.

It is certified that error appears in the above-identified patent and that said Letters Patent is hereby corrected as shown below:

Title page,
Item [56], References Cited, U.S. PATENT DOCUMENTS,
insert -- 5,664,285 9/1997 Melito et al. --.
FOREIGN PATENT DOCUMENTS,
insert the following:

| | | |
|---|---|---|
| -- JP | 57-183942 | 11/1982 |
| JP | 07327888 | 12/1995 |
| JP | 09-192056 | 07/1997 |
| JP | 3067663 | 01/2000 --. |

OTHER PUBLICATIONS,
Insert -- Japanese International Search Report for PCT/JP01/04120 dated 08/28/2001 --.

Column 10,
Line 41, after "chamber" insert -- ; -- (semicolon).

Column12,
Line 32, delete "40" and insert -- 44 --.

Signed and Sealed this

Twenty-seventh Day of June, 2006

JON W. DUDAS
*Director of the United States Patent and Trademark Office*